US006830103B2

(12) United States Patent
Bowles

(10) Patent No.: US 6,830,103 B2
(45) Date of Patent: Dec. 14, 2004

(54) ROLLER SUBS

(75) Inventor: Rodney Gordon Bowles, Norfolk (GB)

(73) Assignee: Weatherford/Lamb, Inc., Houston, TX (US)

( * ) Notice: Subject to any disclaimer, the term of this patent is extended or adjusted under 35 U.S.C. 154(b) by 0 days.

(21) Appl. No.: 10/189,343

(22) Filed: Jul. 3, 2002

(65) Prior Publication Data

US 2003/0015318 A1 Jan. 23, 2003

(30) Foreign Application Priority Data

Jul. 13, 2001 (GB) ..... 0117178

(51) Int. Cl.[7] ..... E21B 17/10

(52) U.S. Cl. ..... 166/241.7; 166/241.3; 175/325.4

(58) Field of Search ..... 166/381, 378, 166/380, 241.1, 241.2, 241.3, 241.7; 175/320, 325.1, 325.2, 325.3, 325.4

(56) References Cited

U.S. PATENT DOCUMENTS

| | | | | | |
|---|---|---|---|---|---|
| 712,487 | A | * | 11/1902 | Black | 166/241.3 |
| 712,488 | A | * | 11/1902 | Black | 166/241.3 |
| 735,200 | A | * | 8/1903 | Black | 384/50 |
| 1,507,972 | A | * | 9/1924 | Loop | 166/241.3 |
| 1,801,294 | A | | 4/1931 | Sutton | |
| 2,061,933 | A | | 11/1936 | Crum | 255/71 |
| 2,198,720 | A | * | 4/1940 | Edgecomb et al. | 166/241.3 |
| 3,545,825 | A | * | 12/1970 | Hamilton | 175/325.4 |
| 3,995,479 | A | * | 12/1976 | Chapman, III | 73/152.47 |
| 4,547,833 | A | * | 10/1985 | Sharp | 361/716 |
| 4,620,802 | A | * | 11/1986 | Harrel | 384/53 |
| 4,621,690 | A | | 11/1986 | Klyne | 166/241 |
| 4,693,328 | A | * | 9/1987 | Furse et al. | 175/275 |
| 4,779,678 | A | * | 10/1988 | White | 166/241.3 |
| 4,793,412 | A | * | 12/1988 | Rivas et al. | 166/241.3 |
| 4,871,020 | A | * | 10/1989 | Rivas et al. | 166/241.3 |
| 4,913,230 | A | * | 4/1990 | Rivas et al. | 166/241.3 |
| 4,919,205 | A | * | 4/1990 | Dollison | 166/241.3 |
| 6,250,406 | B1 | * | 6/2001 | Luke | 175/325.2 |
| 6,382,333 | B1 | * | 5/2002 | Murray | 175/325.3 |
| 6,629,567 | B2 | * | 10/2003 | Lauritzen et al. | 166/380 |
| 2003/0062171 | A1 | * | 4/2003 | Maguire et al. | 166/380 |
| 2003/0106696 | A1 | * | 6/2003 | Lauritzen et al. | 166/380 |

FOREIGN PATENT DOCUMENTS

| | | | | |
|---|---|---|---|---|
| WO | WO 8606784 A1 | * | 11/1986 | E21B/17/10 |
| WO | WO 98/40601 | | 9/1998 | E21B/17/10 |
| WO | WO 99/45229 | | 9/1999 | E21B/17/10 |
| WO | WO 01/40615 A1 | | 6/2001 | E21B/17/10 |

OTHER PUBLICATIONS

International Search Report, International Application No. PCT/GB 02/02842, dated Sep. 4, 2002.

* cited by examiner

*Primary Examiner*—David Bagnell
*Assistant Examiner*—Jennifer H Gay
(74) *Attorney, Agent, or Firm*—Moser, Patterson & Sheridan, L.L.P.

(57) ABSTRACT

The present invention provides a roller sub for use downhole in oil or gas wells as part of a toolstring or drill string to reduce friction between the string and wellbore. The roller sub is a modular assembly of parts which assemble together to trap the roller wheels in place between them, avoiding need for grub screws to fasten the individual wheels and rendering the roller sub very compact.

17 Claims, 6 Drawing Sheets

ROLLER SUBS

FIELD OF THE INVENTION

The present invention concerns improvements in and relating to roller subs for use downhole in oil or gas wells as part of the tool string or drill string to reduce friction between the string and the wellbore.

BACKGROUND TO THE INVENTION

Roller subs are used widely throughout the oil industry but especially in wireline toolstrings, which rely on gravity alone to advance the toolstring, and are especially useful down wells that deviate substantially from the vertical.

Conventional roller subs are generally substantially solid circular cylindrical bodies that are milled to provide radial slots at intervals therearound and therealong. These slots each accommodate a respective roller wheel. Two example prior art configurations of multi-roller wheel sub are illustrated in FIGS. 1 and 2 below.

In the FIG. 1 example the cylindrical body 1, formed with the plurality of slots 2, holds each roller wheel 3 in place in its respective slot by means of a grub screw 4 which locks down onto a radius groove machined into the head of a caphead screw 5 that serves as the axle of the respective roller wheel 3.

In the FIG. 2 example, the roller sub has substantially the same configuration but in this case the axle 6 of each roller wheel 3 has an undercut into which a fixing grub screw 7 locks.

A number of practical problems arise from the use of such conventional designs of multiroller wheel sub, perhaps the most important of which is that the axles and the grub screws and other locking fixtures for holding the roller wheels 3 in place are vulnerable to mechanical failure which may lead to jamming of roller wheels or their loss downhole. Loss of mechanical components such as these downhole is, of course, extremely undesirable since they may interfere with operation of the well and necessitate costly interruption of production to attempt to locate and fish them out.

SUMMARY OF THE INVENTION

According to the present invention there is provided a roller sub for use downhole in oil or gas wells as part of a toolstring or drill string to reduce friction between the string and wellbore, which roller sub carries at least one roller wheel, wherein the roller sub is a modular assembly of parts which assemble together to trap the at least one roller wheel in place between them.

Preferably the modular assembly comprises a body formed of segments.

Suitably the modular assembly body of the roller sub comprises six segments.

Advantageously each roller wheel has integral (i.e. integrally formed or assembled) pivot pin means.

Preferably the pivot pin means of each roller wheel comprise axle stubs that are domed or substantially hemispherical in shape to co-operatively engage with correspondingly shaped recesses in the body of the roller sub.

Suitably each roller wheel has a circumferential groove whereby the roller wheel has a dumbell-like shape in profile.

Advantageously a channel is provided extending longitudinally through the roller sub to serve as a conduit for fluids or electric line.

Preferably part of the channel is defined by the circumferential grooves of the roller wheels.

Figure 1:
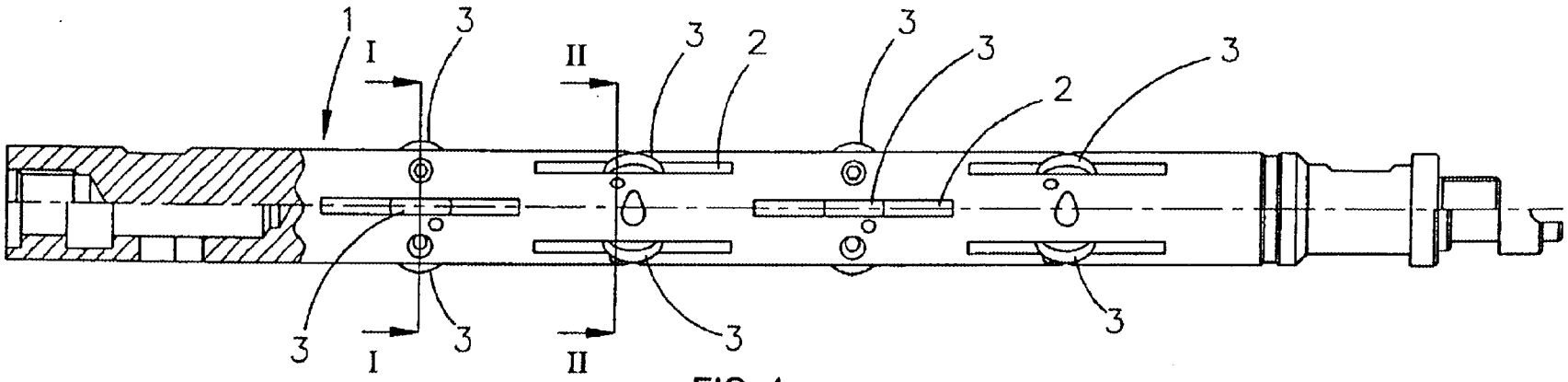
FIG. 1 (PRIOR ART)
FIG. 1 is a side elevation view of a first example of prior art roller sub and with insets showing transverse sections.
Figure 1B:
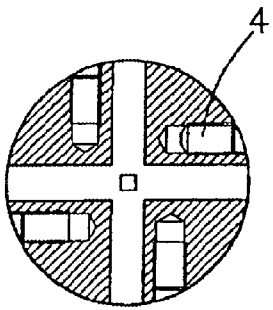
FIGS. 1A and 1B are, respectively, a transverse sectional view taken along the line I—I in FIG. 1 and along the line II—II in FIG. 1.
Figure 1A:
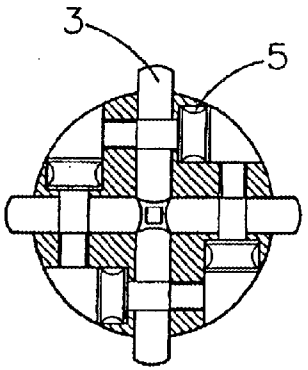
Figure 2:
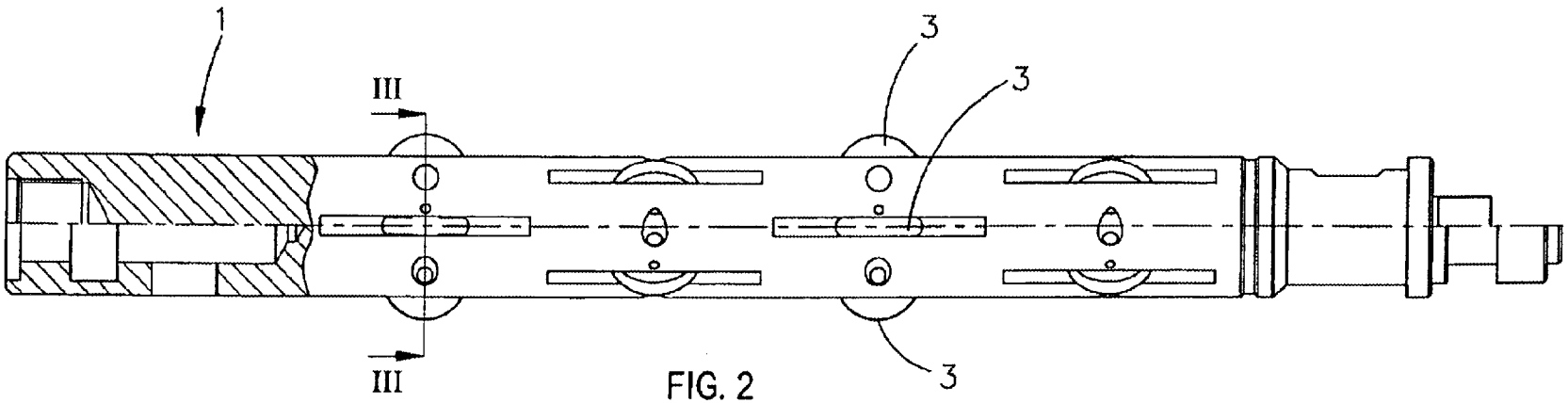
FIG. 2 (PRIOR ART)
FIG. 2 is a side elevation view of a second example of prior art roller sub and with insets showing transverse sections.
Figure 2A:
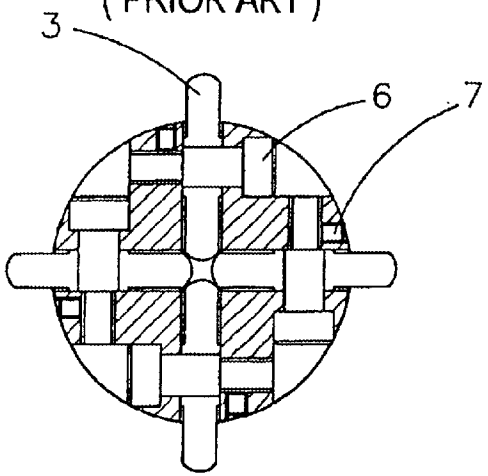
FIG. 2A is a transverse sectional view taken along the line III—III in FIG. 2.
Figure 3:
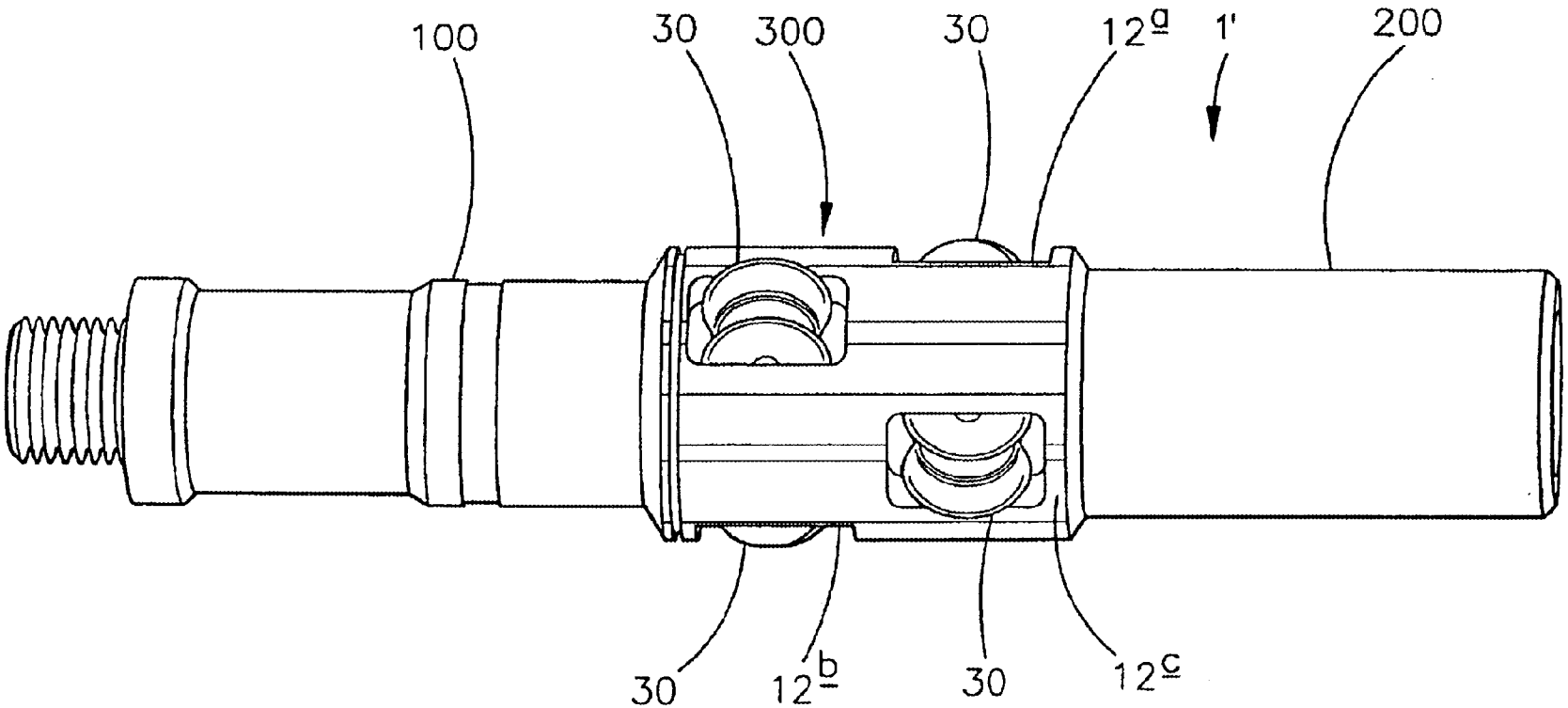
Figure 4A:
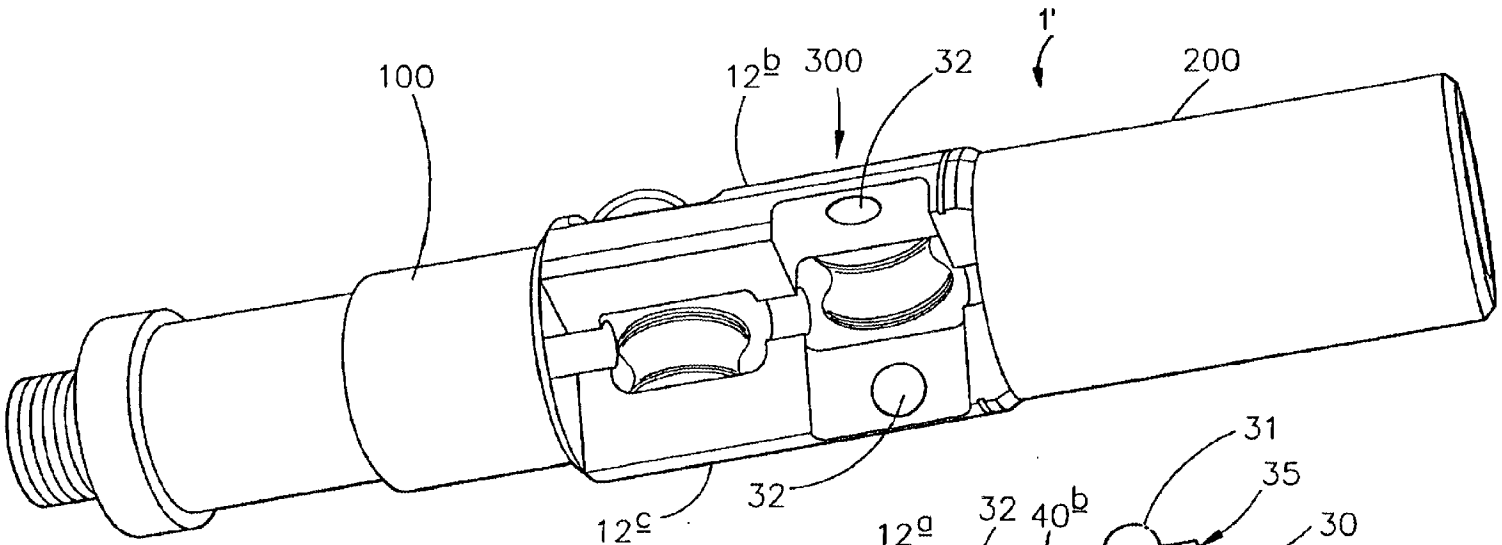
Figure 4B:
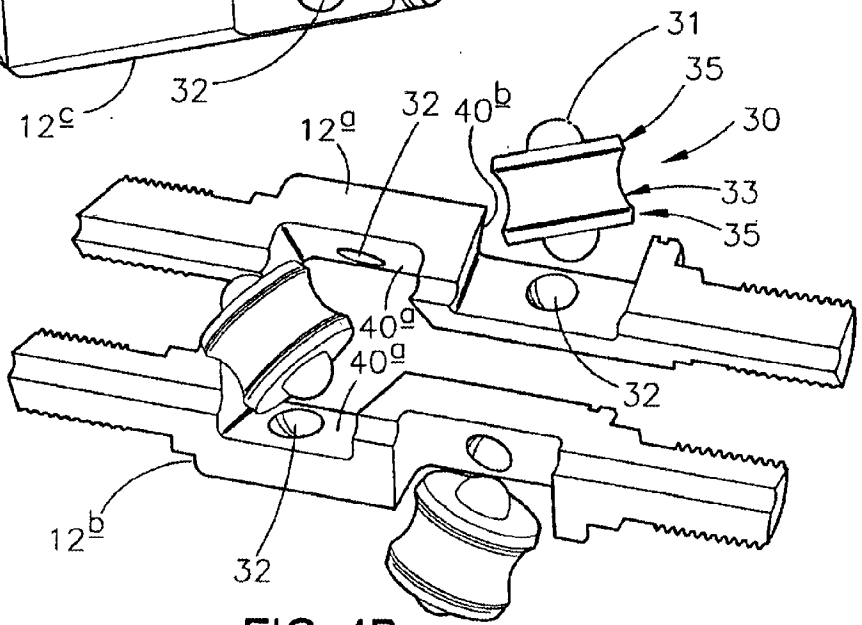

A preferred embodiment of the present invention will be now more particularly described, by way of example, with reference to FIGS. 3 to 6 of the accompanying drawings, wherein:

FIG. 3 is a perspective view of a preferred embodiment of roller sub fully assembled;

FIG. 4 is a perspective view similar to FIG. 3 but with two roller-mounting body segments of the roller sub disassembled therefrom.

Figure 5A:
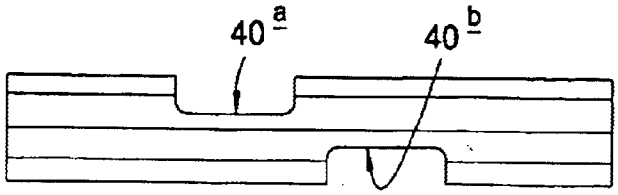
Figure 5B:
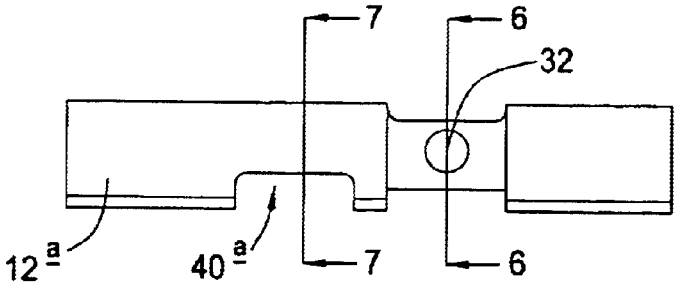
Figure 9:
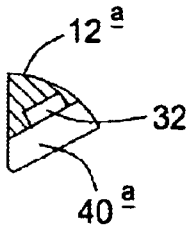
Figure 8:
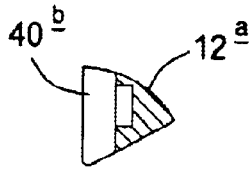
Figure 7:
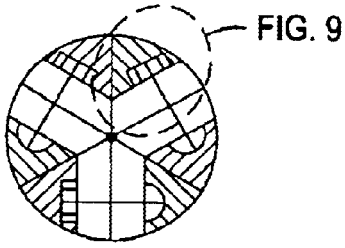
Figure 6:
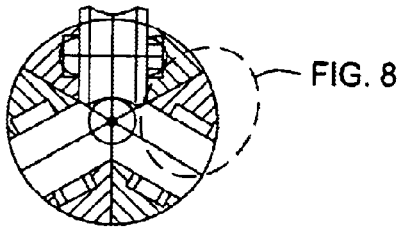
Figure 10:
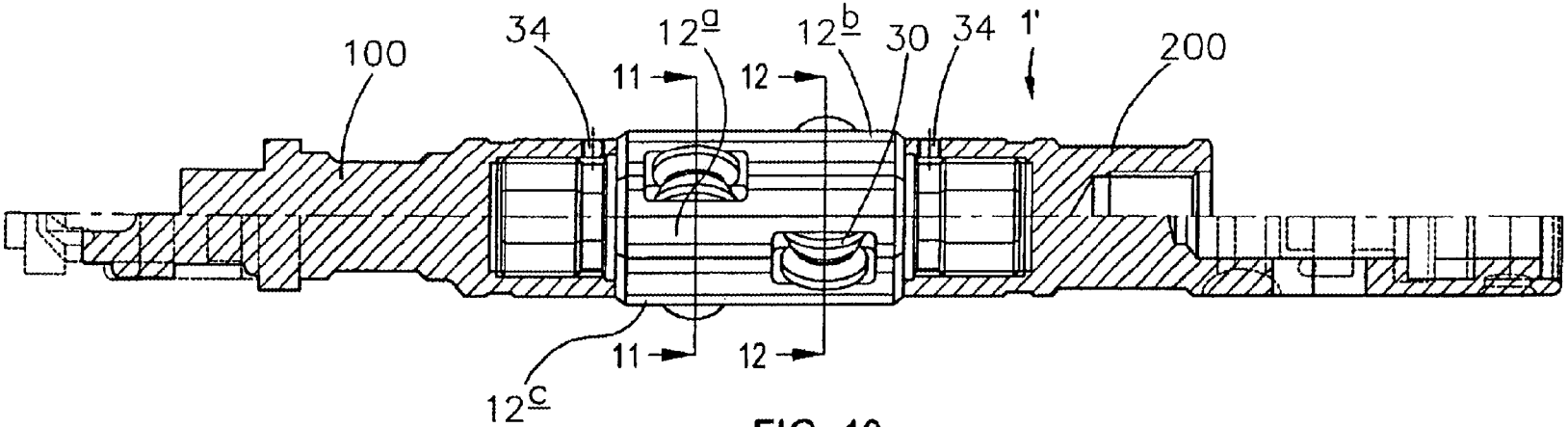
Figure 12:
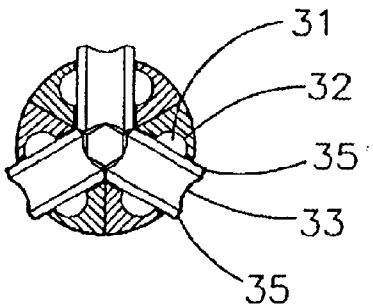
Figure 11:
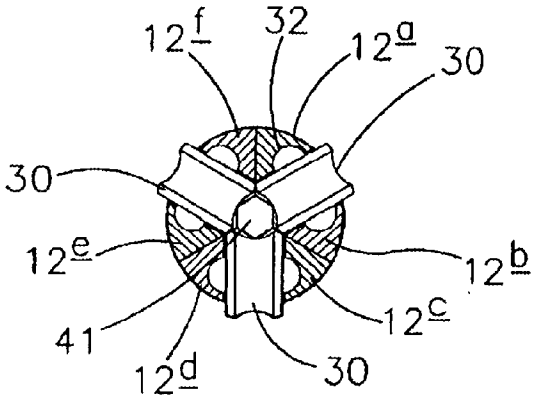

FIGS. 5A and B are, respectively, a plan view of a body segment of the roller sub and a side elevation view of the same;

FIG. 6 is a transverse section along the line 6—6 of the body segment of FIGS. 5A/B and shown schematically in-situ assembled with the other body segments and with a roller wheel shown in ghostline mounted thereto;

FIG. 7 is a transverse section of view of the body segment of FIGS. 5A/B taken along the line 7—7 in FIGS. 5A/B and again shown assembled together with the other segments;

FIG. 8 is an enlarged view of a portion of FIG. 6;

FIG. 9 is an enlarged view of a portion of FIG. 7;

FIG. 10 is a general assembly diagram of the roller sub, as fully assembled, and showing the top sub and bottom sub part cut away; and FIGS. 11 and 12 are, respectively, a transverse sectional view taken along the line 11—11 in FIG. 10 and along the line 12—12 in FIG. 10.

DESCRIPTION OF THE PREFERRED EMBODIMENT

Referring to FIGS. 3 to 12 the roller sub of the present invention does not comprise a one-piece cylindrical body with machined slots for roller wheels as in the prior art. Instead, it comprises a modular assembly of body segments 12*a*–12*f* with the roller wheels 30 each having integrally formed pivot pin means 31 and being substantially encased and thereby locked within the roller sub body 1' during assembly of the body 1'.

The sub body 1' comprises a top sub 100, a bottom sub 200 and an intermediate body part 300. The intermediate body part 300 encases the roller wheels 30 in use and is composed of the body segments 12*a*–12*f* that fit together. In the illustrated form it is composed of six body segments 12*a*–12*f*, two of which are seen disassembled from the sub body 1' in FIG. 4.

The body segments 12*a*–12*f* are formed as metal bars that are of cross sectional shape that is generally a segment of a circle, whereby the assembled sub intermediate part 300 is substantially circular cylindrical. The bars 12*a*–12*f* are suitably cast, but may be machined to have a pair of longitudinally spaced apart recesses 40*a*, 40*b*, angled at different radial orientations. Each recess 40*a*, 40*b* defines half of a cavity to receive a roller wheel 30 and which mates with a recess 40*a*, 40*b* of an adjacent one of the bars 12*a*–12*f* to define a full cavity.

The six body segments 12*a*–12*f* between them define six cavities, each to accommodate a respective one of six roller wheels 30, each wheel 30 oriented radially outwardly at a different orientation from each other and the wheels 30 between them substantially covering the full 3600 circumference around the sub.

Each of the roller wheels 30 is seated within a respective cavity and is held within the cavity by co-operative engagement of the axle stubs 31 of the roller wheel 30 with corresponding sockets 32 in the wall of each opposing recess 40*a*, 40*a*' defining the mounting cavity for the roller wheel 30. Each axle stub socket 32 is suitably a substantially hemispherical recess to receive a corresponding hemispherical shape of axle stub 31.

The simple act of assembling two adjacent body segments 12*a*, 12*b* together around a roller wheel 30 traps it in place between the two. When all six body segments 12*a*–12*f* are assembled together as the intermediate body part 300 trapping all six wheels 30 in place, they are secured together in assembled state by screw thread mounting of the top sub 100 to the upper end of the intermediate body part 300, and with the lower end of the intermediate body part 300 being threadedly coupled with the bottom sub 200.

By screw threaded engagement of the intermediate body part 300 with the top and bottom subs 100, 200 it is possible to completely avoid use of any grub screws or other means of locking the parts together. However, individual grub screws may additionally or alternatively be used for this purpose while still achieving a very marked improvement over the prior art arrangement of roller sub, using only a pair of grub screws 34, one for coupling with the intermediate part 300 with the top sub 100, and the other for coupling with the bottom sub 200.

The provision of the roller wheels 30 with their own integrally formed pivot pin means, i.e axle stubs 31 confers a number of technical benefits. The axle stubs 31 of the roller wheels 30 occupy little volume in comparison to the axles and locking grub screws of the prior art. This provides the opportunity of forming the roller wheel 30 with a broader profile than the conventional wheel, and which suitably has a pulley-like shape, as illustrated, with a prominent rim portion 35 at each end separated by a median groove portion 33.

This profile of the wheel 30 provides for a wide stable wheel while minimising surface contact area. The wheel 30 configuration as a whole is more robust and more stable and spans a greater proportion of the circumference of the roller sub 1', enabling provision of roller wheel 30 contact with the well bore around the full circumference of the roller sub with as few as six wheels 30 and, therefore, within a relatively short length of roller sub, making the whole device far more compact in all respects than the prior art roller sub and utilising less roller wheels 30 as well as avoiding the need for the various other fixing components.

With six wheel-mounting segments and between them carrying six wheels 30, each of wide span, substantially any orientation around the full circumference presents at least a part of a roller wheel 30 to the well bore. This enables, at the simplest level, a tool string to be supported by the one short roller sub at each end of the tool string, avoiding the need for many subs or subs of extended length.

Through avoiding use of separate axles and locking screws and the like, a number of yet further technical benefits ensue. In particular, not only does the assembly of the present invention avoid risk of loss of components down hole but maintenance is also made much simpler. In the prior art configuration great trouble has to be taken in the assembly of the roller wheels to the roller sub to minimise the risk of their falling out, in use, and the locking screws are commonly bonded into place with adhesive, whereby stripping of the tool for maintenance is made awkward and often leads to damage to the screw threads and the need to clean and replace not only the roller wheels, but also the axles and screws. In the case of the present invention the roller sub is disassembled very easily, simply by unscrewing the top and bottom end subs 100, 200 and the service engineer need only clean and replace the roller wheels 30, where necessary.

By forming the axle stubs 31 of the roller wheel 30 to be domed and suitably substantially hemispherical in shape, they are able to support the roller wheel 30 effectively under heavy lateral loads, further enhancing the substantial improvement in strength of the axles.

The roller wheels 30 by virtue of their 'pulley-like' or 'dumbell-shaped' profile, are able to more easily traverse debris downhole. Furthermore, the manner of mounting of the roller wheels within the connector body provides a wheel cavity with better clearance for egress of any debris that might otherwise enter and interfere with operation of the wheel.

The pulley-like or dumbell-shaped profile of the roller wheels 30 has a yet further benefit in that where the roller wheels 30 come together back-to-back in the roller sub, the median groove portion 33 of each wheel 30 combines with the groove 33 of each of the adjacent two wheels 30 to define a substantially sized generally circular or polygonal space 41 which may form part of a conduit that extends through the length of the roller sub. This can best be seen in FIGS. 11, 12 and may be exploited for a number of purposes including accommodating an electric line extending the length of the sub. Indeed, in one embodiment the roller sub may be adapted specifically for this purpose and have a male electrical connector at one end and a female electrical connector at the other end, linked by electrical wire extending between the ends through the conduit 41. Such a configuration is original and is facilitated through the existence of the median grooves 33 of the roller wheels to define the basis for the passage/conduit 41 without wastage of space and enabling maintenance of the compact design of the whole assembly.

The roller sub of the present invention has been tested and established to work efficiently to angles of well bore deviation as much as 88°—e.g. where the toolstring extends initially substantially vertically but turns to extend substantially horizontally downhole.

The compact configuration of the roller sub of the present invention enables it to be scaled down to a diameter as small as 2 inches, if necessary, and still be effective.

What is claimed is:

1. A roller sub for use downhole in oil or gas wells as part of a toolstring or a drill string to reduce friction between the string and a wellbore, the roller sub, comprising:

at least one roller wheel; and a modular assembly of parts retainable by a threaded connection between an upper and a lower tubular, wherein the modular assembly retains the at least one roller wheel in place between them and forms a fluid path through the roller sub.

2. The roller sub as claimed in claim 1, wherein the modular assembly comprises a body formed of segments.

3. The roller sub as claimed in claim 2, wherein the modular assembly body of the roller sub comprises six segments.

4. The roller sub as claimed in claim 1, wherein each roller wheel has a pivot pin member operatively attached to each side thereof.

5. The roller sub as claimed in claim 4, wherein the pivot pin member of each roller wheel comprise axle stubs that are domed or substantially hemispherical in shape to co-operatively engage with correspondingly shaped recesses in the body of the roller sub.

6. The roller sub as claimed in claim 1, wherein each roller wheel has a circumferential groove whereby the roller wheel has a dumbell-like shape in profile.

7. The roller sub as claimed in claim 1, wherein the fluid pathway is a channel extending longitudinally through the roller sub to serve as a conduit for fluids or electric line.

8. The roller sub as claimed in claim 6, wherein the fluid pathway is a channel defined by the circumferential grooves of the roller wheel.

9. A roller sub for use in a wellbore, comprising:

a top sub;

a bottom sub;

a plurality of body segments retainable by a threaded connection at the upper end thereof to the top sub and at the lower end thereof to the bottom sub; and a plurality of rotating members disposable between the plurality of body segments.

10. The roller sub of claim 9, wherein each rotating member having a substantially hemispherical shape formed on each side thereof.

11. The roller sub of claim 10, wherein each body segment includes at least one socket formed therein for receiving the substantially hemispherical shape.

12. The roller sub of claim 9, further including a longitudinal pathway through the roller sub partially defined by the plurality of rotating members.

13. The roller sub of claim 9, wherein the longitudinal pathway is constructed and arranged to accommodate an electric line.

14. The roller sub of claim 13, wherein the electrical line is connected to a male connector is disposed at one end of the roller sub and to a female connector disposed at the other end of the roller sub.

15. A roller sub for use in a wellbore, comprising:

an upper tubular and a lower tubular; and a plurality of body segments to house at least one rotating member, the plurality of body segments retainable by a threaded connection to the upper tubular and the lower tubular.

16. The roller sub of claim 15, wherein a substantially hemispherical shape formed on each side of the at least one rotating member.

17. The roller sub of claim 15, wherein the at least one rotating member is a roller wheel with a circumferential groove formed on an outer surface thereof.

* * * * *